US010082311B2

(12) United States Patent
Ishii et al.

(10) Patent No.: US 10,082,311 B2
(45) Date of Patent: Sep. 25, 2018

(54) DEVICE FOR CONTROLLING AIR CONDITIONER

(71) Applicant: DAIKIN INDUSTRIES, LTD., Osaka-shi, Osaka (JP)

(72) Inventors: Hidehiro Ishii, Plymouth, MN (US); Yasushi Kurosawa, Osaka (JP); Yukihide Yamane, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 321 days.

(21) Appl. No.: 14/978,810

(22) Filed: Dec. 22, 2015

(65) Prior Publication Data

US 2016/0187020 A1 Jun. 30, 2016

(30) Foreign Application Priority Data

Dec. 26, 2014 (JP) ..... 2014-264197

(51) Int. Cl.

| | |
|---|---|
| ***F24F 11/00*** | (2018.01) |
| ***F24F 11/30*** | (2018.01) |
| ***F24F 11/62*** | (2018.01) |
| *F24F 11/56* | (2018.01) |

(52) U.S. Cl.

CPC ..... *F24F 11/006* (2013.01); *F24F 11/30* (2018.01); *F24F 11/62* (2018.01); *F24F 11/56* (2018.01)

(58) Field of Classification Search

CPC ..... F24F 11/0086

See application file for complete search history.

(56) References Cited

U.S. PATENT DOCUMENTS

2012/0199660 A1* 8/2012 Warren ..... F24F 11/0012 236/1 C

FOREIGN PATENT DOCUMENTS

JP 6-94289 A 4/1994

* cited by examiner

*Primary Examiner* — Thomas L Dickey

(74) *Attorney, Agent, or Firm* — Birch, Stewart, Kolasch & Birch, LLP

(57) ABSTRACT

A device for controlling an air conditioner has a remote controller which receives an alternating current voltage from a secondary side of a first transformer, a full-wave rectifier connected to a secondary side of a second transformer, and a processor which receives a current rectified by the full-wave rectifier. One of output nodes of the full-wave rectifier is connected to one terminal of the secondary side of the first transformer. The remote controller has a switch connected to the secondary side of the first transformer, and transmits information that indicates a state of the switch to the processor as the amplitude of an AC voltage on a signal line connecting the remote controller and the processor together.

3 Claims, 3 Drawing Sheets

DEVICE FOR CONTROLLING AIR CONDITIONER

CROSS-REFERENCE TO RELATED APPLICATION

This application claims priority to Japanese Patent Application No. 2014-264197 filed on Dec. 26, 2014, the disclosure of which, including the specification, the drawings, and the claims, is hereby incorporated by reference in its entirety.

BACKGROUND

The present disclosure relates to an air conditioner and a device for controlling the air conditioner.

In air conditioners, it is common to maintain communication between an indoor unit and an outdoor unit. For example, Japanese Unexamined Patent Publication No. H6-094289 discloses an example technique for maintaining communication between the indoor unit and the outdoor unit, using a photocoupler having a photodiode and a phototransistor.

On the other hand, information has also been transmitted using the voltage amplitude of a communication line without a photocoupler, which allows for lower cost communication.

SUMMARY

However, without the photocoupler, the communication line is not electrically insulated from an alternating-current (AC) power supply, a receiving circuit, and other components. Thus, the communication is easily affected by noise or a potential offset between a transmitting circuit and a receiving circuit, for example.

Further, in such an air conditioner in which information is transmitted using the voltage amplitude of a communication line, a half-wave rectified direct current is ordinarily supplied to the receiving circuit. In order to achieve high efficiency, it is desirable to supply a full-wave rectified direct current to such a receiving circuit. However, if a full-wave rectifier is connected to the same AC power supply to which the destination device is also connected, the output of the full-wave rectifier will be floating with respect to the AC power supply, which will negatively affect the communication.

It is an object of the present disclosure to more accurately transmit information when using the voltage amplitude of a communication line.

A device for controlling an air conditioner according to the present disclosure includes: a first transformer configured to output an alternating current (AC) voltage different from an input voltage; a second transformer configured to output an AC voltage different from an input voltage; a remote controller configured to receive the AC voltage from a secondary side of the first transformer; a full-wave rectifier connected to a secondary side of the second transformer; and a processor configured to receive a current rectified by the full-wave rectifier, and to control the air conditioner. One of output nodes of the full-wave rectifier is connected to one terminal of the secondary side of the first transformer, and the remote controller has a switch connected to the secondary side of the first transformer, and transmits information that indicates a state of the switch to the processor as the amplitude of an AC voltage on a signal line connecting the remote controller and the processor together.

DETAILED DESCRIPTION

Figure 1:
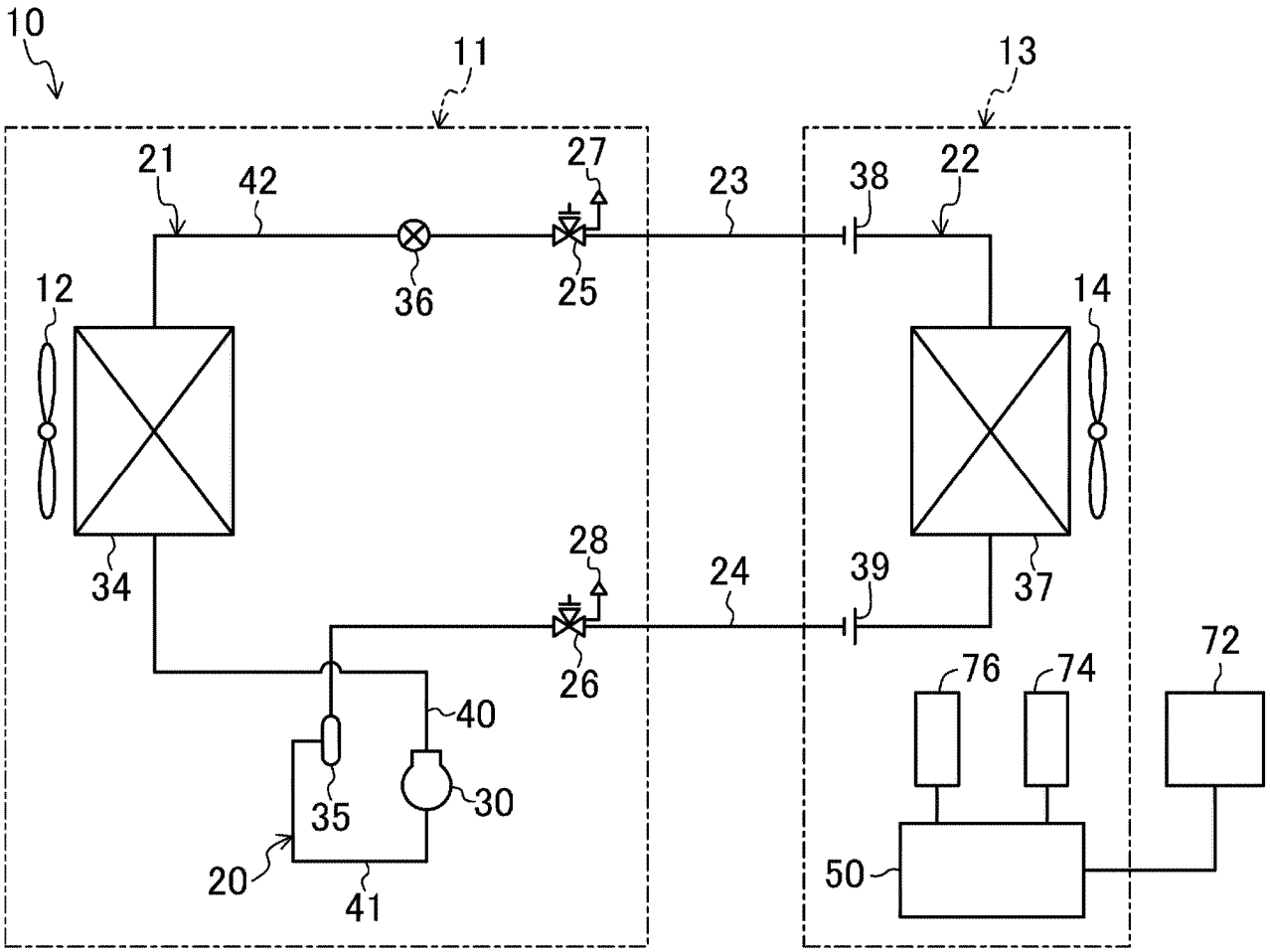
FIG. 1 illustrates a configuration for an example air conditioner according to an embodiment of the present invention.

An embodiment of the present invention will now be described in detail with reference to the drawings. In the drawings, the same reference characters are used to designate identical or similar elements. The term "connect" or "connection" means either an indirect or direct electrical connection. Thus, if a first device is connected to a second device, that connection may be through a direct electrical connection, or through an indirect electrical connection via other devices and connections.

FIG. 1 illustrates an example configuration for an air conditioner 10 according to an embodiment of the present invention. The air conditioner 10 of FIG. 1 has an outdoor unit 11, which is a heat source unit, and an indoor unit 13, which is a utilization unit. Note that the number of indoor units 13 is not limited to one, and may be any other number.

The outdoor unit 11 includes an outdoor circuit 21, which is a heat source circuit. The indoor unit 13 includes an indoor circuit 22, which is a utilization circuit. The air conditioner 10 includes a refrigeration circuit 20 which is formed by connecting the outdoor circuit 21 and the indoor circuit 22 through a liquid communication pipe 23 and a gas communication pipe 24 and which performs a vapor-compression refrigeration cycle.

The outdoor circuit 21 of the outdoor unit 11 includes a compressor 30, an outdoor heat exchanger (a heat source-side heat exchanger) 34, an expansion valve (an expansion mechanism) 36, and an accumulator 35. One end of the outdoor circuit 21 is provided with a liquid stop valve 25 to which the liquid communication pipe 23 is connected. The other end of the outdoor circuit 21 is provided with a gas stop valve 26 to which the gas communication pipe 24 is connected.

The liquid stop valve 25 has a liquid service port 27 which is open to the liquid communication pipe 23 when the liquid stop valve 25 is closed, whereas the gas stop valve 26 has a gas service port 28 which is open to the gas communication pipe 24 when the gas stop valve 26 is closed. These ports 27, 28 are used to collect the refrigerant in the refrigeration circuit 20 and to fill the refrigeration circuit 20 with the refrigerant, and are closed during a cooling operation.

The compressor 30 is configured as a high-pressure dome type hermetic compressor. The discharge side of the compressor 30 is connected to the outdoor heat exchanger 34 through a discharge pipe 40. The suction side of the compressor 30 is connected to the gas stop valve 26 through a suction pipe 41.

The outdoor heat exchanger 34 is configured as a crossed fin-and-tube heat exchanger. In the outdoor unit 11, an outdoor fan 12 is provided in the vicinity of this outdoor heat exchanger 34. The outdoor heat exchanger 34 exchanges heat between outdoor air blown by the outdoor fan 12 and a refrigerant flowing in a heat-transfer tube. One end of the outdoor heat exchanger 34 is connected to the compressor 30 through the discharge pipe 40. The other end of the outdoor heat exchanger 34 is connected to the liquid stop valve 25 through a liquid pipe 42.

The liquid pipe 42 is provided with an expansion valve 36 between the outdoor heat exchanger 34 and the liquid stop valve 25. The expansion valve 36 is configured as an electronic expansion valve, of which the degree of opening is variable.

The suction pipe 41 is provided with the accumulator 35. The accumulator 35 is formed as a hermetic container, and accumulates therein a liquid refrigerant separated from the refrigerant flowing toward the compressor 30 to prevent the compressor 30 from sucking the liquid refrigerant.

The indoor circuit 22 of the indoor unit 13 is provided with an indoor heat exchanger 37. One end of the indoor circuit 22 is provided with a liquid side flared fitting 38 to which the liquid communication pipe 23 is connected. The other end of the indoor circuit 22 is provided with a gas side flared fitting 39 to which the gas communication pipe 24 is connected.

The indoor heat exchanger 37 is configured as a crossed fin-and-tube heat exchanger. An indoor fan 14 is provided in the vicinity of this indoor heat exchanger 37. The indoor heat exchanger 37 exchanges heat between indoor air blown by the indoor fan 14 and the refrigerant flowing in the heat-transfer tube.

A cooling operation of the air conditioner 10 will now be described. When the compressor 30 is activated, the refrigeration circuit 20 performs a vapor-compression refrigeration cycle in which the outdoor heat exchanger 34 functions as a condenser and the indoor heat exchanger 37 functions as an evaporator. The degree of opening of the expansion valve 36 is appropriately adjusted.

In this state, the refrigerant discharged from the compressor 30 exchanges heat with the outdoor air in the outdoor heat exchanger 34 and is condensed. The refrigerant which has been condensed in the outdoor heat exchanger 34 is decompressed while passing through the expansion valve 36, and thereafter exchanges heat with the indoor air in the indoor heat exchanger 37 and evaporates. The refrigerant which has evaporated in the indoor heat exchanger 37 is sucked into the compressor 30 and is compressed. During the cooling operation, the refrigerant circulates in the refrigeration circuit 20 as described above to cool the room air.

The indoor unit 13 further includes a control device 50 for controlling the air conditioner 10, a heater kit 74, and a humidifier unit 76. The control device 50 controls operations of the elements of the air conditioner 10, such as the expansion valve 36. The air conditioner 10 further includes a remote controller 72. The remote controller 72 is connected to the control device 50, and transmits an instruction to the control device 50.

Figure 2:
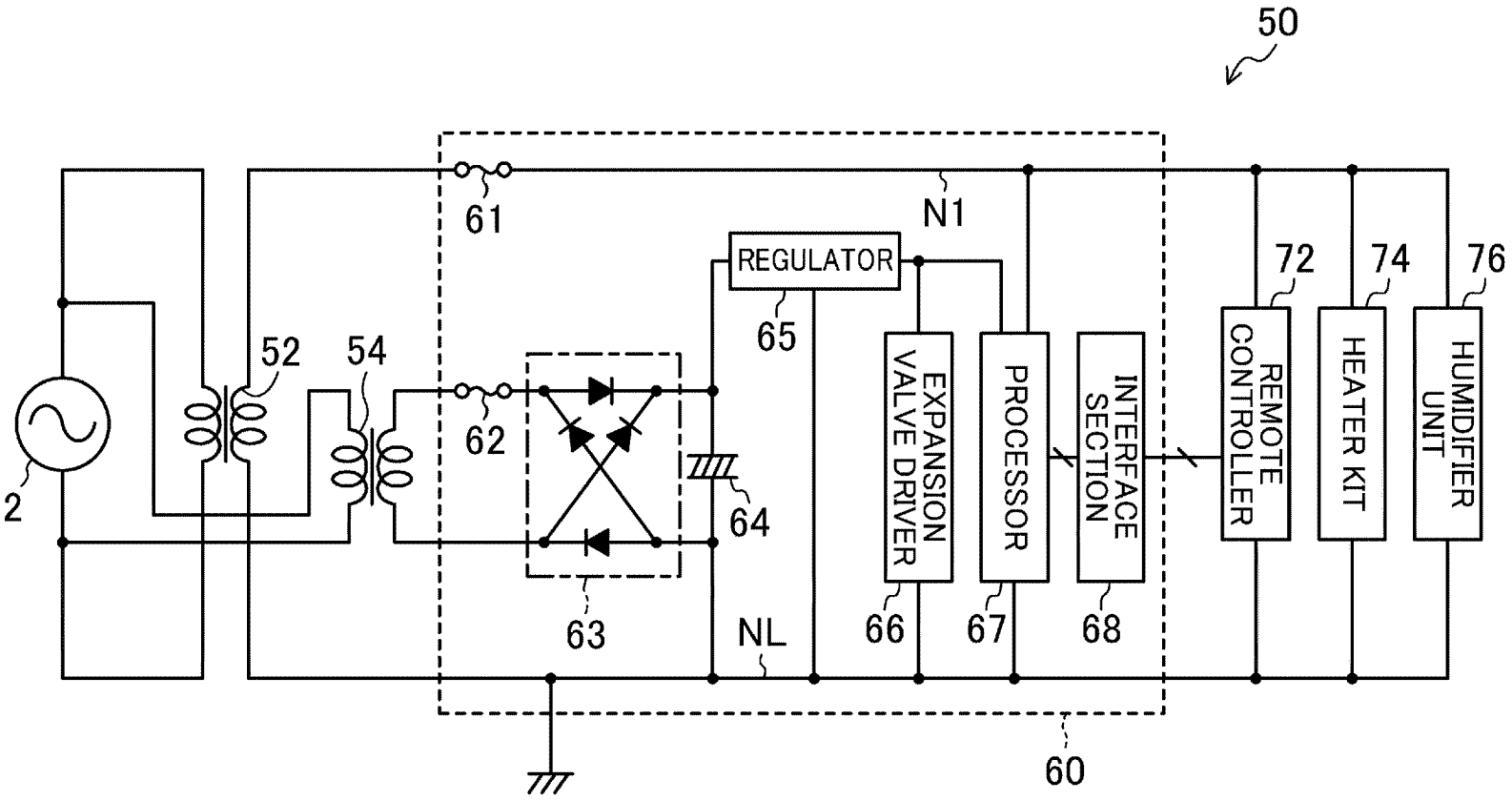
FIG. 2 is a circuit diagram illustrating an example electric circuit including the indoor unit shown in FIG. 1 and its peripheral devices.

FIG. 2 is a circuit diagram illustrating an example electric circuit of the indoor unit 13 shown in FIG. 1 and its peripheral devices. The control device 50 includes a transformer 52 for supplying an alternating current, a transformer 54 for supplying a direct current, and a control circuit 60. The control circuit 60 includes fuses 61, 62, a full-wave rectifier 63, a capacitor 64, a regulator 65, an expansion valve driver 66, a processor 67, and an interface section 68. The control circuit 60 may be formed on a printed circuit board, for example. The transformer 54 may also be mounted on the printed circuit board.

The primary side of the transformer 52 is connected to an AC power supply 2. The secondary side of the transformer 52 is connected to the remote controller 72, heater kit 74, and humidifier unit 76 via the fuse 61. The transformer 52 lowers an AC voltage input to its primary side, and outputs the resultant AC voltage different from the input voltage to its secondary side. One terminal of the secondary side is grounded.

The primary side of the transformer 54 is connected to the AC power supply 2. The secondary side of the transformer 54 is connected to the rectifier 63 via the fuse 62. The transformer 54 lowers an AC voltage input to its primary side, and outputs the resultant AC voltage different from the input voltage to its secondary side.

The rectifier 63 performs a full-wave rectification on the alternating current received from the transformer 54 and outputs a direct current. The capacitor 64 is connected between the output nodes of the rectifier 63. The capacitor 64 smooths the direct current output from the full-wave rectifier 63. The regulator 65 stabilizes the output of the rectifier 63 to a predetermined voltage, and supplies it to the expansion valve driver 66 and the processor 67.

The expansion valve driver 66 drives the expansion valve 36 illustrated in FIG. 1. The processor 67 controls various devices of the air conditioner 10 such as the expansion valve driver 66. The processor 67 receives the information transmitted from the remote controller 72 via the interface section 68.

In this case, of the two output nodes of the rectifier 63, the output node NL with the lower potential is connected not only to the expansion valve driver 66 and the processor 67, but also to the grounded terminal of the secondary side of the transformer 52. Other devices such as the remote controller 72 are also connected to this terminal. Thus, the processor 67 and the remote controller 72 can share the common potential when operating, thereby causing no potential offset.

If the rectifier 63 were connected to the secondary side of the transformer 52, the output node NL of the rectifier 63 could not be connected directly to the secondary side of the transformer 52, because if so, the rectifier 63 would not be able to provide full-wave rectification. On the other hand, the control device 50 has a transformer 54 independent of the transformer 52, and the rectifier 63 is connected to the secondary side of the transformer 54. The output node NL of the rectifier 63 may therefore be connected directly to the secondary side of the transformer 52.

Further, this control device 50 uses the full-wave rectifier 63, and therefore, can transform the incoming alternating current into a direct current more efficiently than in a situation where a half-wave rectification is performed. Thus, the sum of the capacities of the transformers 52 and 54 can be reduced.

Figure 3:
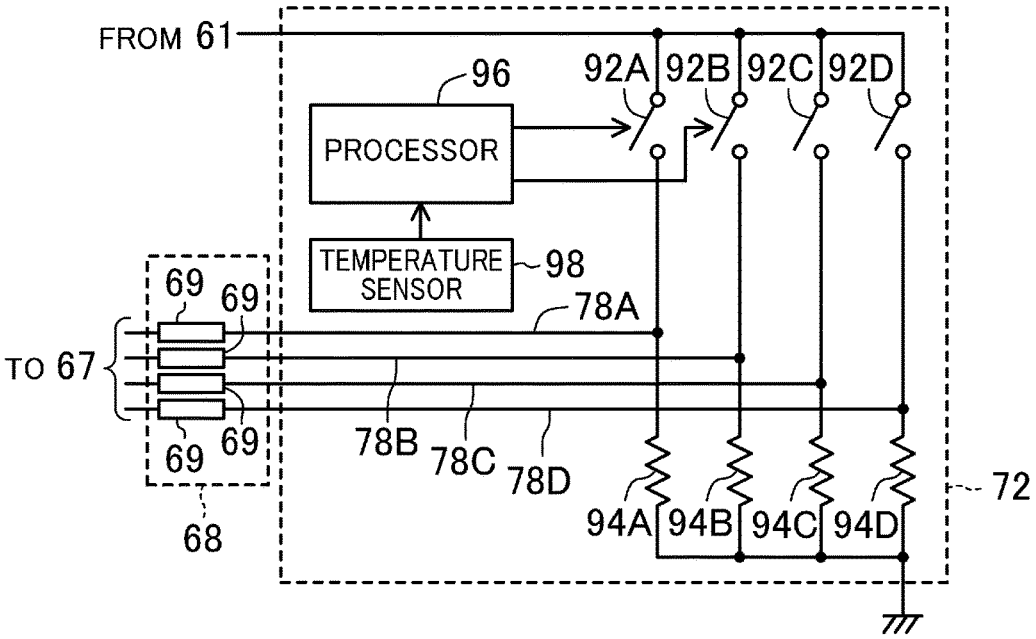
FIG. 3 is a circuit diagram illustrating an example configuration for the remote controller and interface section shown in FIG. 2.

FIG. 3 is a circuit diagram illustrating an example configuration for the remote controller 72 and interface section 68 illustrated in FIG. 2. The remote controller 72 includes switches 92A, 92B, 92C, 92D, resistors 94A, 94B, 94C, 94D, a processor 96, and a temperature sensor 98. The interface section 68 may have four interface circuits 69, for example. The switches 92A, 92B, 92C, 92D are closed when, for example, a cooling operation, heating operation, fan operation, and dehumidifying operation should be carried out, respectively.

The switch 92A and the resistor 94A are connected in series between the output nodes of the secondary side of the transformer 52. The switch 92B and the resistor 94B are also connected in series between the output nodes of the secondary side of the transformer 52. The switch 92C and the resistor 94C are also connected in series between the output nodes of the secondary side of the transformer 52. The switch 92D and the resistor 94D are also connected in series between the output nodes of the secondary side of the transformer 52.

A signal line 78A connects the node between the switch 92A and the resistor 94A to one of the interface circuits 69. A signal line 78B connects the node between the switch 92B and the resistor 94B to another interface circuit 69. A signal line 78C connects the node between the switch 92C and the resistor 94C to still another interface circuit 69. A signal line 78D connects the node between the switch 92D and the resistor 94D to yet another interface circuit 69.

Figure 4:
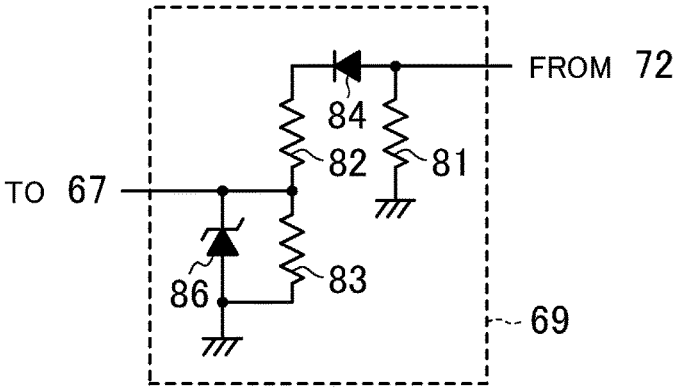
FIG. 4 is a circuit diagram illustrating an example configuration for one of the interface circuits shown in FIG. 3.

FIG. 4 is a circuit diagram illustrating an example configuration for one of the interface circuits 69 shown in FIG. 3. The interface circuit 69 includes resistors 81, 82, 83, a diode 84, and a Zener diode 86.

A signal input to the interface circuit 69 is rectified by the diode 84, has its voltage divided by the resistors 82, 83, has its amplitude limited by the Zener diode 86, and then input to the processor 67. The processor 67 determines whether or not the voltage of the input signal is larger than a predetermined value. In other words, the processor 67 receives information representing the amplitude of the AC voltage supplied to the interface circuit 69.

The switches 92A, 92B, 92C, 92D are usually open. In such a state, the amplitude of the voltage on each of the signal lines 78A, 78B, 78C, 78D is zero. The temperature sensor 98 detects the temperature of a room where the remote controller 72 is placed, and notifies the processor 96 in the remote controller 72 of the detected temperature. If the detected temperature is higher than a predetermined value, the processor 96 closes the switch 92A. When the switch 92A is closed, the voltage on the signal line 78A becomes equal to the AC voltage output from the secondary side of the transformer 52.

The voltage on the signal line 78A is input to the associated one of the interface circuits 69, and as described above, the processor 67 determines whether the amplitude of that voltage is larger than a predetermined value. In other words, the remote controller 72 transmits information that indicates a state of the switch 92A to the processor 67 as the amplitude of the AC voltage on the signal line 78A. When the switch 92A is closed, the processor 67 instructs the air conditioner 10 to perform a cooling operation.

If the detected temperature is lower than the predetermined value, the processor 96 closes the switch 92B. The user closes the switches 92C, 92D when needed. As in the case of the switch 92A, the remote controller 72 transmits information that indicates states of the switches 92B, 92C, 92D to the processor 67 as the amplitude of the AC voltage on the signal lines 78B, 78C, 78D, respectively. When the switch 92B is closed, the processor 67 instructs the heater kit 74 to generate heat. When the switch 92D is closed, the processor 67 instructs the humidifier unit 76 to humidify the room air.

One terminal of each of the resistors 94A, 94B, 94C, 94D, as well as the processor 67, is grounded, which means that these elements have the same reference potential in common. Thus, the remote controller 72 outputs, to the signal lines 78A, 78B, 78C, 78D, the AC voltage, of which the amplitude represents the states of the respective switches 92A, 92B, 92C, 92D. As a result, information that indicates the states of the switches 92A, 92B, 92C, 92D can be accurately transmitted to the processor 67.

Further, the processor 67 detects a voltage at the node N1 between the remote controller 72, to which the alternating current is supplied from the transformer 52, and the fuse 61. If the fuse 61 is not blown, the output voltage of the transformer 52 is detected by the processor 67. On the other hand, if the fuse 61 is blown, a significantly decreased voltage is detected by the processor 67. For example, the fuse 61 may be blown if any device, to which an alternating current is supplied from the transformer 52, is wired improperly.

Thus, the processor 67 detects blowing of the fuse 61 based on the voltage at the node N1. For example, the processor 67 determines that the fuse 61 has been blown if the amplitude of the voltage at the node N1 is smaller than a predetermined value.

Since a current is supplied to the processor 67 and other devices via the fuse 62, the processor 67 can continue to control the air conditioner 10 even if the fuse 61 is blown, and can also notify the user that an abnormal condition has occurred. If the processor 67 has determined that the fuse 61 has been blown, the processor 67 may notify the user that the air conditioner 10 cannot operate properly or that there may be improper wiring, or may stop the operation of the air conditioner 10.

Each functional block herein can be typically implemented as hardware. For example, each functional block may be implemented on a semiconductor substrate as a part of an integrated circuit (IC). Here, an IC includes a large-scale integrated circuit (LSI), an application-specific integrated circuit (ASIC), a gate array, a field programmable gate array (FPGA), etc. Alternatively, a part or the entire part of each functional block may be implemented as software. For example, such a functional block may be implemented by a processor and a program that can be executed on the processor. In other words, each functional block herein may be implemented as hardware, software, or any combination of hardware and software.

The many features and advantages of the present disclosure are apparent from the detailed specification and, thus, it is intended by the appended claims to cover all such features and advantages of the present disclosure which fall within the true spirit and scope of the invention. Further, since numerous modifications and changes will readily occur to those skilled in the art, it is not desired to limit the present disclosure to the exact construction and operation illustrated and described, and accordingly all suitable modifications and equivalents may be resorted to, falling within the scope of the invention.

What is claimed is:

1. A device for controlling an air conditioner, comprising:

a first transformer configured to output an alternating current (AC) voltage different from an input voltage;

a second transformer configured to output an AC voltage different from an input voltage;

a remote controller configured to receive the AC voltage from a secondary side of the first transformer;

a full-wave rectifier connected to a secondary side of the second transformer; and a processor configured to receive a current rectified by the full-wave rectifier, and to control the air conditioner, wherein one of output nodes of the full-wave rectifier is connected to one terminal of the secondary side of the first transformer, the remote controller has a switch connected to the secondary side of the first transformer, and transmits information that indicates a state of the switch to the processor as the amplitude of an AC voltage on a signal line connecting the remote controller and the processor together, and the processor is further configured to detect a voltage at a node from which the remote controller is configured to receive the AC voltage from the secondary side of the first transformer, and detect an abnormal condition of the air conditioner based on the detected voltage, and provide notification of the detected abnormal condition.

2. A device for controlling an air conditioner, comprising:

a first transformer configured to output an alternating current (AC) voltage different from an input voltage;

a second transformer configured to output an AC voltage different from an input voltage;

a remote controller configured to receive the AC voltage from a secondary side of the first transformer;

a full-wave rectifier connected to a secondary side of the second transformer;

a processor configured to receive a current rectified by the full-wave rectifier, and to control the air conditioner;

a first fuse which is connected to the secondary side of the first transformer and through which a current to be supplied from the first transformer to the remote controller flows; and a second fuse which is connected to the secondary side of the second transformer and through which a current to be supplied from the second transformer to the processor flows, wherein one of output nodes of the full-wave rectifier is connected to one terminal of the secondary side of the first transformer, and the remote controller has a switch connected to the secondary side of the first transformer, and transmits information that indicates a state of the switch to the processor as the amplitude of an AC voltage on a signal line connecting the remote controller and the processor together.

3. The device of claim 2, wherein the processor is configured to determine that the first fuse has been blown.

* * * * *